US008663038B2

(12) United States Patent
Bowman

(10) Patent No.: US 8,663,038 B2
(45) Date of Patent: Mar. 4, 2014

(54) BASKETBALL HOOP AND NET ASSEMBLY

(76) Inventor: Trevor Bowman, Queensland (AU)

( * ) Notice: Subject to any disclaimer, the term of this patent is extended or adjusted under 35 U.S.C. 154(b) by 312 days.

(21) Appl. No.: 13/268,222

(22) Filed: Oct. 7, 2011

(65) Prior Publication Data

US 2013/0090191 A1 Apr. 11, 2013

(51) Int. Cl.
*A63B 63/08* (2006.01)

(52) U.S. Cl.
USPC ..... 473/485

(58) Field of Classification Search
USPC ..... 473/447, 448, 449, 485, 488; D21/702, D21/703, 704
See application file for complete search history.

(56) References Cited

U.S. PATENT DOCUMENTS

| | | | | | |
|---|---|---|---|---|---|
| 2,199,609 | A | * | 5/1940 | Bennett | 473/485 |
| 2,489,174 | A | * | 11/1949 | Cunningham | 473/485 |
| 2,579,312 | A | * | 12/1951 | Garvey | 473/489 |
| 2,666,641 | A | * | 1/1954 | Bonham | 473/485 |
| 3,565,427 | A | * | 2/1971 | Michael | 473/485 |
| D238,284 | S | * | 12/1975 | Toedter | D21/703 |
| 4,071,238 | A | * | 1/1978 | Chapman | 473/485 |
| 4,241,916 | A | * | 12/1980 | Palm | 473/485 |
| 4,353,548 | A | | 10/1982 | Mahoney | |
| D340,486 | S | * | 10/1993 | Rothbard | D21/703 |
| 5,447,304 | A | | 9/1995 | Vargas | |
| 5,458,325 | A | * | 10/1995 | Klein et al. | 473/485 |
| 5,524,883 | A | | 6/1996 | Allen et al. | |
| 5,792,010 | A | | 8/1998 | Allen et al. | |
| 5,795,253 | A | | 8/1998 | Allen | |
| 5,951,416 | A | | 9/1999 | Allen et al. | |
| 6,312,350 | B1 | | 11/2001 | White | |
| 6,595,879 | B1 | | 7/2003 | Robbins | |
| 6,652,396 | B2 | * | 11/2003 | McBride | 473/485 |
| 6,746,349 | B2 | | 6/2004 | Neiberger et al. | |
| 7,396,302 | B1 | | 7/2008 | Boudreau | |
| 2003/0190985 | A1 | * | 10/2003 | Neiberger et al. | 473/485 |
| 2013/0090191 | A1 | * | 4/2013 | Bowman | 473/485 |

FOREIGN PATENT DOCUMENTS

EP 0692282 A1 1/1996

* cited by examiner

*Primary Examiner* — Gene Kim
*Assistant Examiner* — Mike Chambers
(74) *Attorney, Agent, or Firm* — Porzio, Bromberg & Newman, P.C.

(57) ABSTRACT

The invention therefore provides a basketball hoop and net assembly having (i) a hoop or ring and a wave shaped rail attached thereto which depends downwardly from the hoop or ring so as to form a plurality of valleys thereby to provide apertures between the hoop or ring and each valley; and (ii) a net assembly having a top cord and a multiplicity of upper net loops attached thereto characterized in that the top cord has a multiplicity of inner parts and a plurality of outer parts and each inner part extends through a pair of adjacent primary apertures and each outer part is located outwardly of a secondary aperture wherein each secondary aperture is located proximal to a respective primary aperture and each upper net loop extends around each outer part.

3 Claims, 3 Drawing Sheets

BASKETBALL HOOP AND NET ASSEMBLY

BACKGROUND OF THE INVENTION

1. Field of the Invention

This invention relates to a basketball hoop and net assembly suitable for playing basketball, netball or similar games.

2. Description of Related Art

Conventional basketball hoop assemblies often include a hoop or ring having a plurality of hooks or holders attached to an underside or undersurface of the hoop or ring through which a plurality of net loops supporting a net are attached wherein each net loop is passed through an adjacent hook or holder. In another arrangement the hoop or ring included a plurality of apertures through which each net loop is passed.

Basketball hoop assemblies of the type described above are referenced in U.S. Pat. Nos. 5,524,883, 4,071,238, 5,792,010, 6,746,349, 5,951,416, 5,795,253, 5,447,304, 6,312,350, 6,595,879, 7,396,302 and EP 0692282.

In relation to the provision of holders or hooks attached to the basketball hoop these are generally made of wire and have a horizontal part welded to the underside of the hoop and thus are very susceptible to breaking off from the hoop with repeated ball contact. Also the net frequently becomes tangled with these holders or hooks and another problem with these holders or hooks is that they have straight parts which are often sharp and are thus capable of causing injury. Another problem is that manufacturing of a hoop with attached net holders or hooks are not appropriate for mass manufacture. These problems also had relevance to the use of apertures in the hoop or ring.

In another conventional arrangement, there may be provided a hoop or ring assembly having a top ring and a bottom ring wherein the bottom ring has a number of valleys and curved horizontal portions between each valley and wherein each curved horizontal portion is welded or attached to the top ring and a plurality of net loops supporting a net are attached to each valley.

In regard to the provision of the bottom ring as described above, it was often the case that the net was caused to break away from the hoop after repeated ball contact or frequent use because each of the net loops was only supported by a plurality of spaced locations.

U.S. Pat. No. 4,353,548 relates to a top cord supporting a basketball net having net loops passed over the top cord wherein the top cord and each net loop is received within an aperture of a connector member welded to a net connector ring which is welded to a basketball hoop. However this arrangement was considered to be complicated in construction.

Another conventional method of attachment of a basketball net to a hoop was to attach or weld a plurality of curved tube segments to an underside of the hoop with a small gap between adjacent segments. A cord is then passed through each of the tube segments and net loops of a net are attached to the cord in the gaps between each segment. Each end of the cord was then connected by a knot. However problems with this arrangement were that it was difficult to get sufficient tension on the cord to limit the sag of the net upon repeated downward pull of the net. Also, with repeated downward pull of the net the cord became abraded against the edge of each tube segment. Also, each tube had sharp edges capable of causing injury.

It is therefore an object of the invention to provide a basketball hoop and net assembly which may alleviate the problems of the prior art discussed above.

SUMMARY OF THE INVENTION

The invention therefore provides a basketball hoop and net assembly having (i) a hoop or ring and a wave shaped rail attached thereto which depends downwardly from the hoop or ring so as to form a plurality of valleys thereby to provide apertures between the hoop or ring and each valley; and (ii) a net assembly having a top cord and a multiplicity of upper net loops attached thereto characterized in that the top cord has a multiplicity of inner parts and a plurality of outer parts and each inner part extends through a pair of adjacent primary apertures and each outer part is located outwardly of a secondary aperture wherein each secondary aperture is located proximal to a respective primary aperture and each upper net loop extends around each outer part.

The wave shaped rail is suitably formed from metal or steel bar having a circular cross section and may have any suitable diameter which may be from 4-8 mm and more suitably 6 mm.

The amplitude of the wave rail can vary but is best formed to a minimum aperture or gap distance from the hoop so as to allow a relatively thick net to pass so that the net is securely retained to the hoop.

BRIEF DESCRIPTION OF THE DRAWINGS

Reference may be made to a preferred embodiment of the invention as shown in the attached drawings wherein.

DETAILED DESCRIPTION

Figure 1:
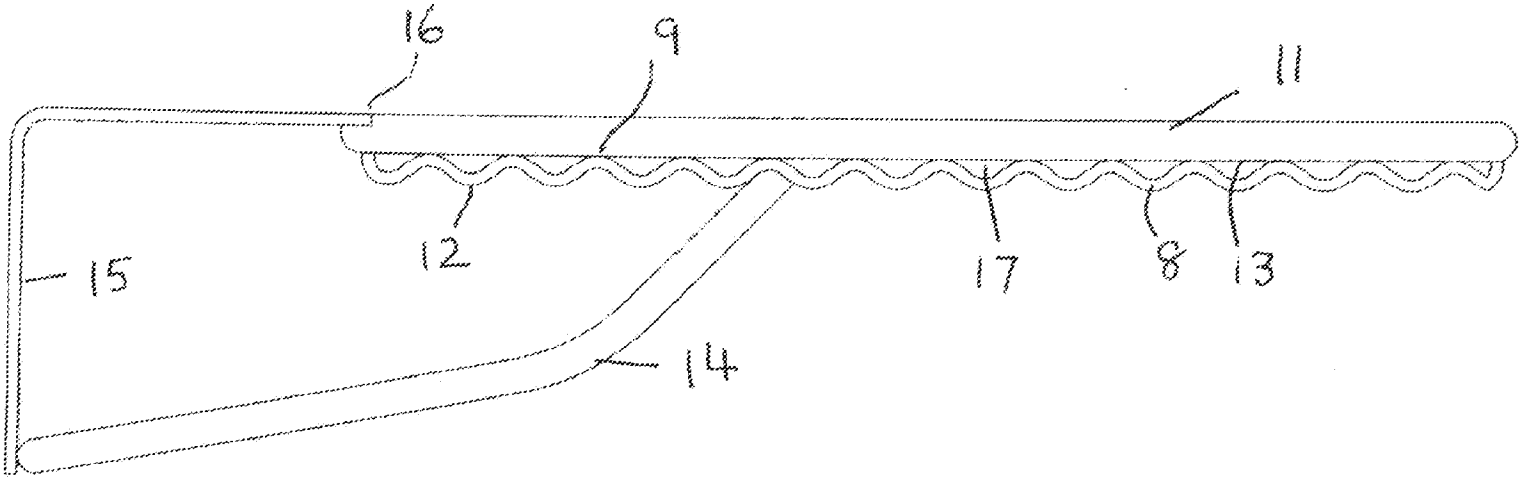
FIG. 1 is a side view of the basketball hoop having the wave shaped rail attached thereto and the net omitted for clarity.

Reference will now be made in greater detail to a preferred embodiment of the invention, an example of which is illustrated in the accompanying drawings. Wherever possible, the same reference numerals will be used throughout the drawings and the description to refer to the same or like parts.

In the drawings, there is shown in FIG. 1 a basketball hoop or ring 11, wave shaped rail 12 welded or otherwise attached to an underside or bottom part 13 of ring 11, brace 14 and mounting plate 15 welded to ring 11 at 16 wherein hoop and net assembly 10 can be attached to a suitable support such as a backboard (not shown) located at one end of a basketball court by suitable fasteners (not shown). The wave rail 12 has a plurality of peaks 9 attached to ring 11 and a multiplicity of valleys 8. There is also shown a plurality of apertures 17 between valleys 8 and ring 11.

Figure 2:
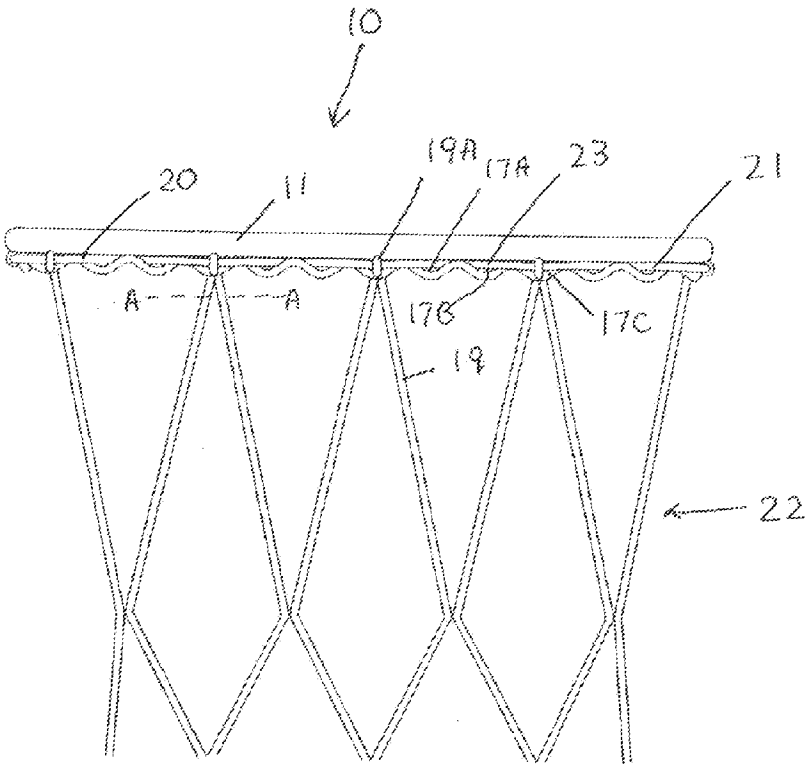
FIG. 2 is a side view of the basketball hoop having the net attached thereto.

In FIG. 2 there is shown a basketball hoop-net assembly 10 having a net 22 having a number of upper net loops 19 which extend around or are looped over an outer part 20 of top cord 21 at 19A. The apertures 17 are formed into a series of mutually adjacent primary pairs of apertures 17A and 17B and a plurality of secondary apertures 17C wherein each secondary aperture 17C is located adjacent to a respective primary aperture 17A and 17B. Each inner part 23 of top cord

21 extends through each pair of primary apertures 17A and 17B and each outer part 20 is located outwardly of a proximal secondary aperture 17C.

Figure 3:
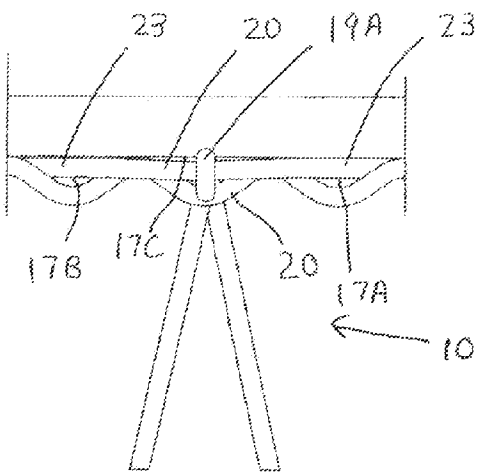
FIG. 3 is a detailed view of how each upper net loop of the net is attached to each outer part of the top cord.

This is also clearly shown in FIG. 3 which shows a section A-A of FIG. 2 wherein each secondary aperture 17C is located between primary apertures 17B and 17A. Outer part 20 is located outwardly of secondary aperture 17C and each inner part 23 extends between each of adjacent apertures 17A and 17B.

Figure 4:
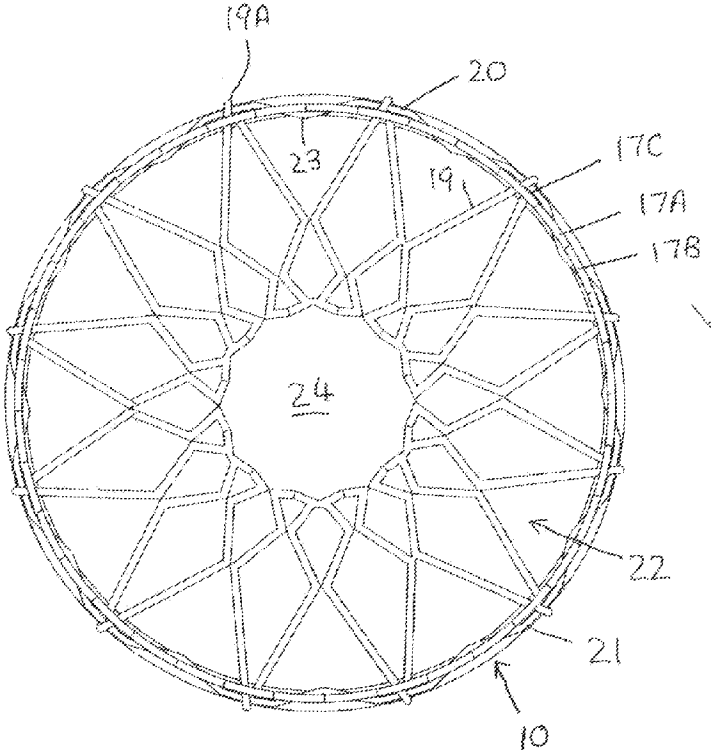
FIG. 4 is a bottom plan view of the basketball hoop-net assembly shown in FIG. 2.

In FIG. 4 this arrangement is also shown in a bottom plan view and there is also shown outlet 24 of net 18.

Figure 5:
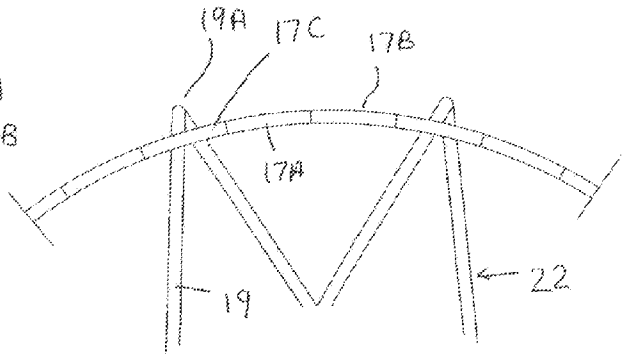
FIG. 5 is a plan view of a pair of adjacent net loops and the location of the wave shaped rail with the top cord omitted for clarity.

FIG. 5 shows how each upper net loop 19 at 19A is looped adjacent aperture 17C with top cord 21 being omitted for convenience. Each of mutually adjacent primary apertures 17A and 17B are shown through which inner parts 23 may extend as shown in FIG. 4.

It therefore will be appreciated in the illustrated embodiment shown in FIGS. 1-5 that there are 36 apertures 17 which are divided into pairs of primary apertures 17A and 17B and secondary apertures 17C located adjacent a respective aperture 17A and 17B.

The advantages of the basketball hoop and net assembly as described above is that the upper net loops 19 are securely retained in the outer parts 20 of the top cord 21 and are prevented from gaining access to the inner parts 23 of the top cord or a location inwardly of the hoop or ring 11. The loops 19 are wedged between the outer parts 20 and each aperture 17 and are very tightly retained in the hoop or ring 11. This arrangement eliminates sharp edges from being present and also eliminates protrusions which may catch part of a net 22 when it moves or rebounds in use. It also provides tension and friction to the top cord 21 wherein the inner parts 23 of the top cord 21 provide a firm non moving support for each net loop 19.

It will be appreciated that wave shaped rail 12 is suitably in the shape of a continuous wave having a constant amplitude.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A basketball hoop and net assembly having (i) a hoop or ring and a circular wave shaped rail attached thereto which depends downwardly from the hoop or ring so as to form a plurality of valleys thereby to provide apertures between the hoop or ring and each valley; and (ii) a net assembly having a top cord and a multiplicity of upper net loops attached thereto characterized in that the top cord has a multiplicity of inner parts and a plurality of outer parts and each inner part extends through a pair of primary adjacent apertures and each outer part is located outwardly of a secondary aperture wherein each secondary aperture is located proximal to a respective primary aperture and each upper net loop extends around each outer part.

2. The basketball hoop and net assembly of claim 1, wherein the hoop or ring has a back plate for attachment to a suitable support and a brace extending between the hoop or ring and the back plate.

3. A basketball hoop and net assembly having (i) a hoop or ring and a circular wave shaped rail attached thereto which depends downwardly from the hoop or ring so as to form a plurality of valleys thereby to provide apertures between the hoop or ring and each valley; and (ii) a net assembly having a top cord and a multiplicity of upper net loops attached thereto characterized in that the top cord has a multiplicity of inner parts and a plurality of outer parts and each inner part extends through a respective two of said apertures and each outer part is located outwardly of an adjacent aperture and each upper net loop extends around each outer part.

* * * * *